US007252550B1

(12) United States Patent
Yamaji et al.

(10) Patent No.: US 7,252,550 B1
(45) Date of Patent: Aug. 7, 2007

(54) CONNECTOR

(75) Inventors: Takahiro Yamaji, Tokyo (JP); Kazukuni Hisatomi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/599,057

(22) Filed: Nov. 14, 2006

(30) Foreign Application Priority Data

May 31, 2006 (JP) ..... 2006-152191

(51) Int. Cl.
*H01R 13/648* (2006.01)

(52) U.S. Cl. ..... 439/607; 439/680

(58) Field of Classification Search ..... 439/374, 439/108, 607, 660, 680
See application file for complete search history.

(56) References Cited

U.S. PATENT DOCUMENTS 4,787,860 A * 11/1988 Bender ..... 439/358
5,108,311 A * 4/1992 Nakazawa ..... 439/607
5,306,196 A * 4/1994 Hashiguchi ..... 439/607
5,417,590 A * 5/1995 Dechelette et al. ..... 439/607

FOREIGN PATENT DOCUMENTS

JP 2004-327168 A 11/2004

* cited by examiner

*Primary Examiner*—Khiem Nguyen
(74) *Attorney, Agent, or Firm*—Frishauf, Holtz, Goodman & Chick, P.C.

(57) ABSTRACT

A connector whose guide sections are hardly damaged by a mating connector even if it is inserted into in a prying manner. A housing is formed with a receiving hole for receiving a plug-side connector, and two guide sections at opposite ends of the receiving hole in a contact arrangement direction, for guiding the plug-side connector in a fitting direction. A shell made of a metal plate is comprised of a first covering section that covers a first outer surface of the housing, substantially parallel to the contact arrangement direction, a second covering section that covers a second outer surface of the housing, substantially parallel to the contact arrangement direction, and two connecting sections that connect the first covering section and the second covering section, and covers opposite ends of a front of the housing. The two connecting sections are each formed with a cutout having a pair of guide surfaces opposed to each other in a direction of thickness of the housing, for guiding the plug-side connector in the fitting direction.

1 Claim, 5 Drawing Sheets

CONNECTOR

BACKGROUND OF THE INVENTION

1. Field of the Invention

This invention relates to a connector, and more particularly to a connector provided with a shell.

2. Prior Art

Conventionally, there has been proposed a connector provided with a shell (see Japanese Laid-Open Patent Publication (Kokai) No. 2004-327168, Paragraph numbers [0036], [0046], and [0048]).

An insulator (housing) of the connector has a fitting hole (receiving hole) for receiving a connecting section of a mating connector. Guide sections for guiding the mating connector in a fitting direction are located at opposite ends of the fitting hole 31 of the insulator in a contact arrangement direction.

The shell is formed by pressing a metal plate, and includes a top portion, a bottom portion, and a connecting portion connecting these portions.

The shell has a front face formed with a guide surface for guiding the mating connector into the fitting hole. The guide surface is inclined with respect to the fitting direction.

When the mating connector is inserted into the fitting hole of the connector in a manner prying in the direction of thickness thereof (by an operation wobbling the mating connector), the guide surface of the shell is brought into abutment with the mating connector, but an angle formed between the guide surface and the lower surface of the mating connector is small and the guide surface is elastically deformable, which makes it almost impossible to suppress the prying motion of the mating connector. Therefore, there has been a fear that the guide sections are damaged or broken.

SUMMARY OF THE INVENTION

The present invention has been made in view of these circumstances, and an object thereof is to provide a connector whose guide sections are hardly damaged by a mating connector even if the mating connector is inserted into the connector in a prying manner.

To attain the above object, the present invention provides a connector comprising a housing that holds a plurality of contacts, and includes a receiving hole for receiving a mating connector, and two guide sections located at respective opposite ends of the receiving hole in a contact arrangement direction, for guiding the mating connector in a fitting direction, and a shell that is formed by a metal plate, and includes a first covering section that covers a first outer surface of the housing, the first outer surface being substantially parallel to the contact arrangement direction, a second covering section that covers a second outer surface of the housing, the second outer surface being substantially parallel to the contact arrangement direction, and two connecting sections that connect the first covering section and the second covering section and cover opposite ends of a front of the housing, wherein the two connecting sections have respective cutouts opposed to the guide sections in the fitting direction, and each cutout has a pair of guide surfaces opposed to each other in a direction of thickness of the housing, for guiding the mating connector in the fitting direction.

With the configuration of this connector, the two connecting sections have respective cutouts opposed to the guide sections in the fitting direction, and each cutout has the pair of guide surfaces opposed to each other in the direction of thickness of the housing, for guiding the mating connector in the fitting direction. Therefore, when the mating connector is inserted into the receiving hole in a manner prying in the direction of thickness of the housing, the pair of guide surfaces receive the mating connector. As a result, the prying motion of the mating connector is suppressed. Therefore, even if the mating connector is inserted into the connector in a prying manner, guide sections of the connection are hardly damaged by the mating connector.

The above and other objects, features and advantages of the present invention will become more apparent from the following detailed description taken in conjunction with the accompanying drawings.

DETAILED DESCRIPTION OF THE PREFERRED EMBODIMENTS

The present invention will now be described in detail with reference to the drawings showing preferred embodiments thereof.

Figure 1:
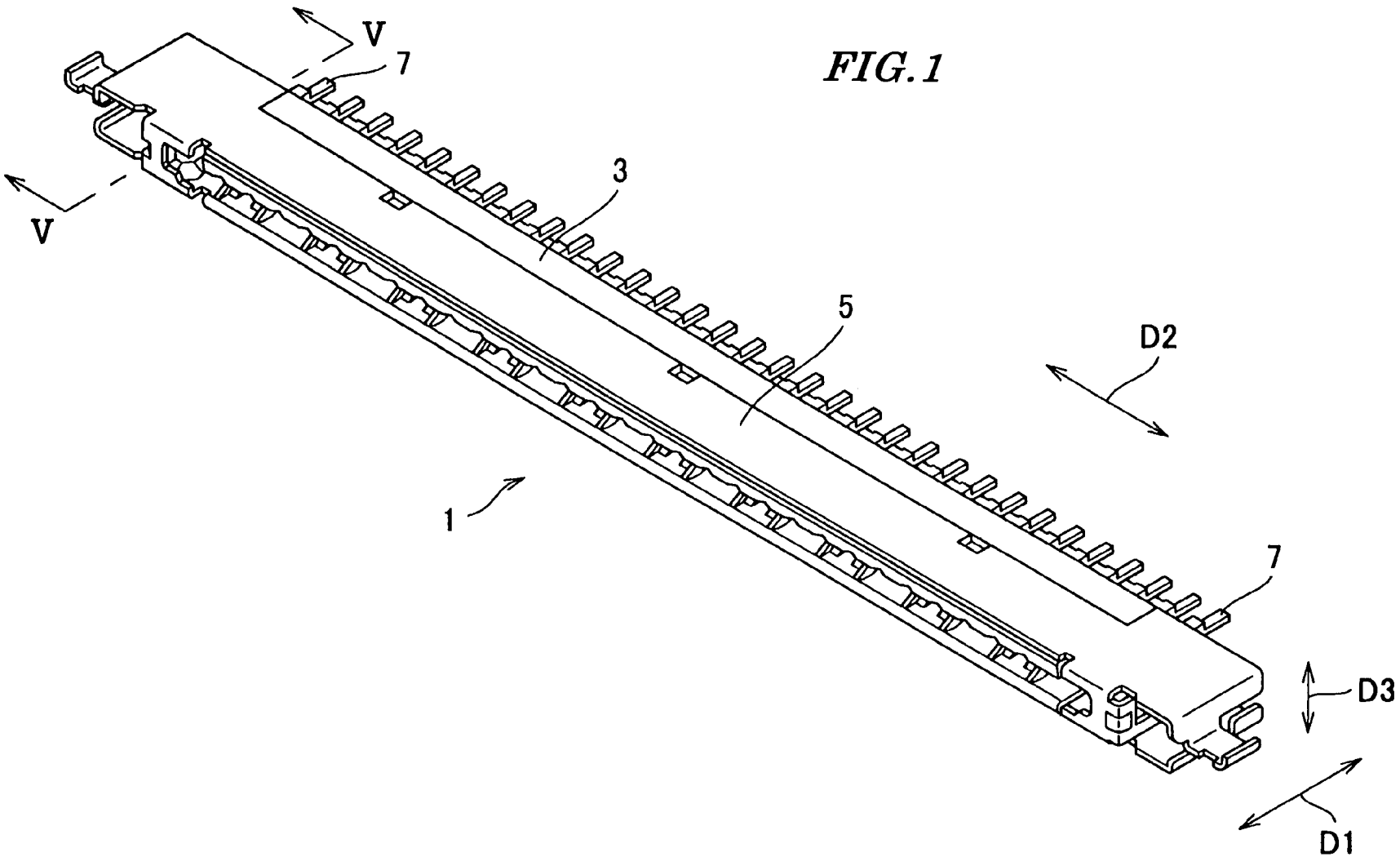
FIG. 1 is a perspective view of a receptacle-side connector according to an embodiment of the present invention.
Figure 2:
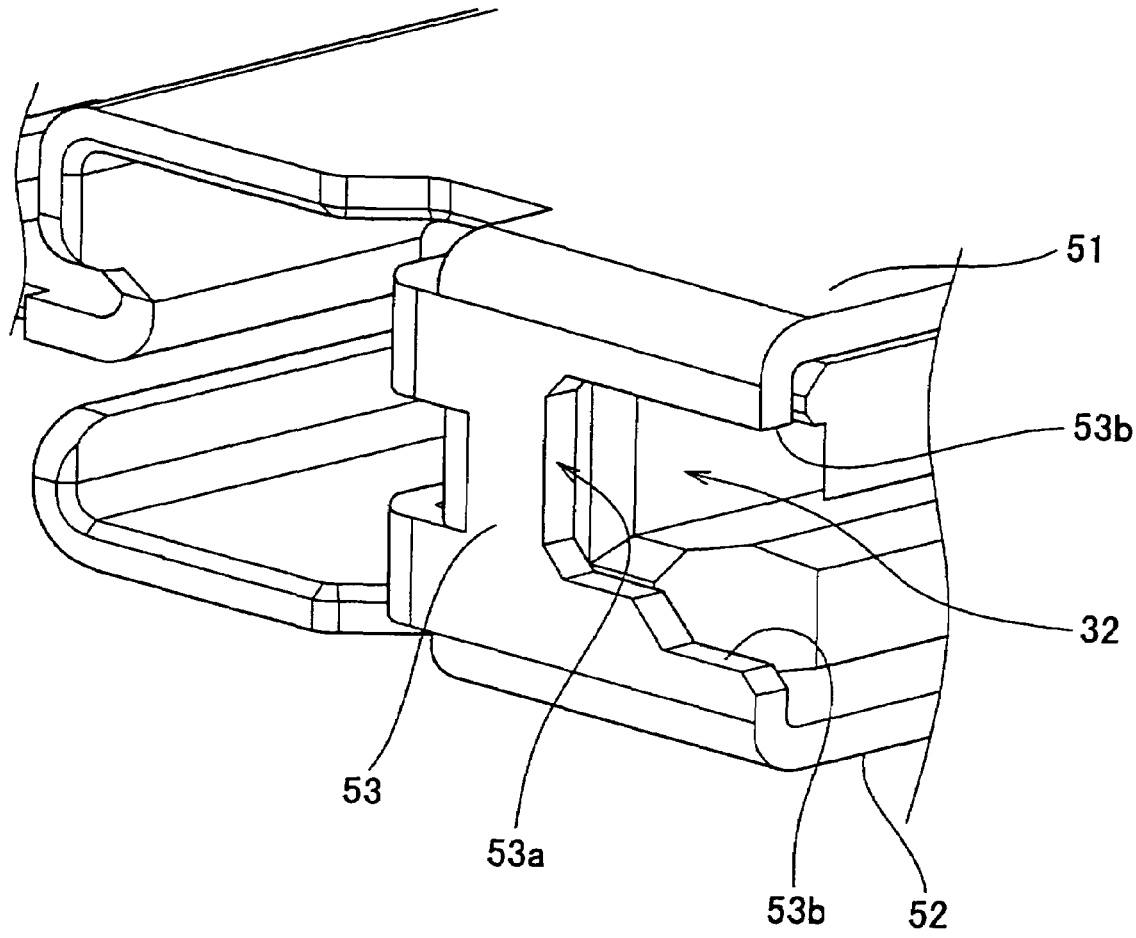
FIG. 2 is a fragmentary perspective view of a connecting section of a shell of the receptacle-side connector shown in FIG. 1.
Figure 3:
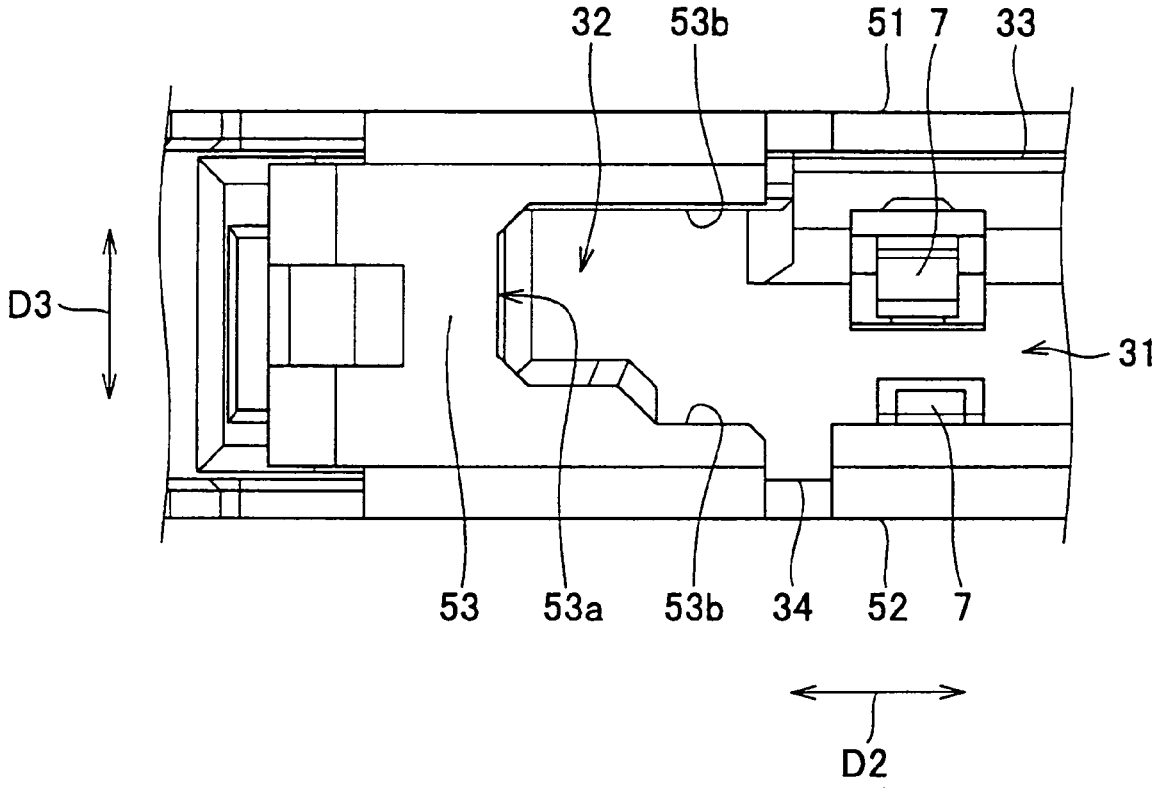
FIG. 3 is a fragmentary front view of the connecting section of the shell of the receptacle-side connector shown in FIG. 1.
Figure 4:
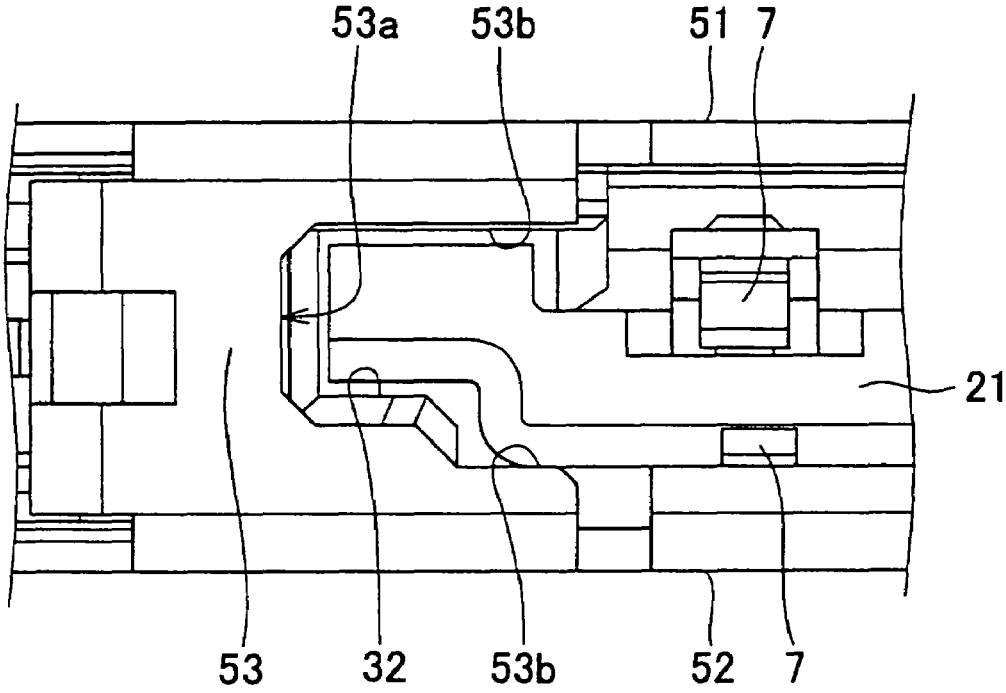
FIG. 4 is a fragmentary front view of the FIG. 1 receptacle-side connector and a plug-side connector in a state in which the plug-side connector is fitted to the receptacle-side connector.
Figure 5:
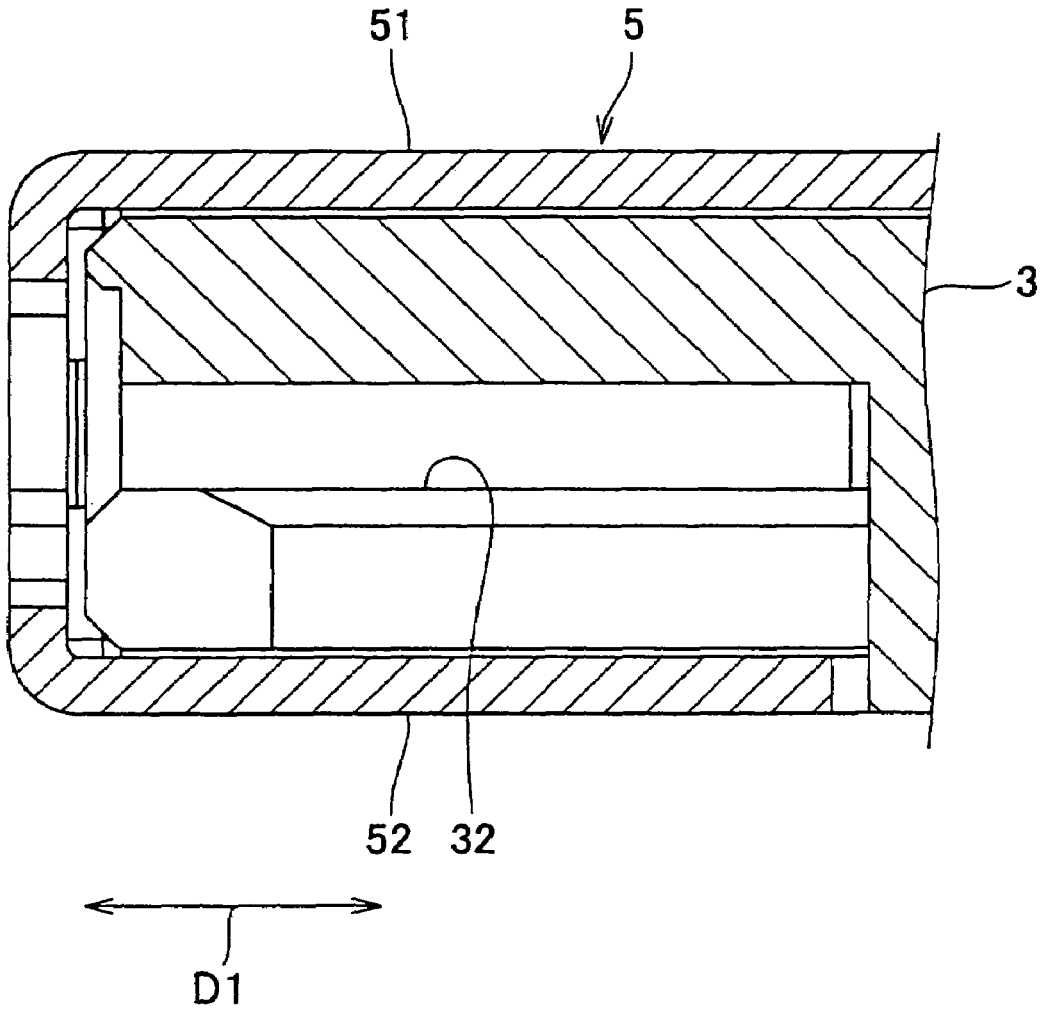
FIG. 5 is a cross-sectional view taken on line V-V of FIG. 1.

FIG. 1 is a perspective view of a receptacle-side connector according to an embodiment of the present invention. FIG. 2 is a perspective view of a connecting section of a shell of the receptacle-side connector shown in FIG. 1. FIG. 3 is a front view of the connecting section of the shell of the receptacle-side connector shown in FIG. 1. FIG. 4 is a front view of the FIG. 1 receptacle-side connector and a plug-side connector in a state in which the plug-side connector is fitted to the receptacle-side connector. FIG. 5 is a cross-sectional view taken on line V-V of FIG. 1.

Referring to FIGS. 1 to 5, the receptacle-side connector (connector) 1 is comprised of a housing 3 and a shell 5.

The housing 3 is formed of a synthetic resin, and has a receiving hole 31 and two guide sections 32. The receiving hole 31 receives the plug-side connector (mating connector) 21. A plurality of contacts 7 are held by the housing 3 along a contact arrangement direction D2.

The two guide sections 32 are located at opposite ends of the housing 3 in the contact arrangement direction D2, and guide the plug-side connector 21 in a fitting direction D1.

The shell 5 is formed e.g. by bending a metal plate having a predetermined shape, and includes a first covering section 51, a second covering section 52, and two connecting sections 53.

The first covering section 51 covers a top surface 33 (first outer surface substantially parallel to the contact arrangement direction D2) of the housing 3.

The second covering section 52 covers a bottom surface 34 (second outer surface substantially parallel to the contact arrangement direction D2) of the housing 3.

The two connecting sections 53 connect the first covering section 51 and the second covering section 52, and cover opposite ends of a front of the housing 3. The two connecting sections 53 are each formed with a cutout 53*a*. The cutouts 53*a* are opposed to the guide sections 32 in the fitting direction D1. Each cutout 53*a* has a pair of guide surfaces 53*b*. The pair of guide surfaces 53*b* are opposed to each other in the direction D3 of the thickness of the housing 3. Further, the pair of guide surfaces 53*b* guide the plug-side connector 21 along the fitting direction D1.

The pair of guide surfaces 53*b* are formed by forming the cutout 53*a* and are substantially parallel to the fitting direction D1 and the contact arrangement direction D2. Further, the pair of guide surfaces 53*b* sandwich the plug-side connector 21.

In inserting the plug-side connector 21 into the receiving hole 31 of the receptacle-side connector 1, if the plug-side connector 21 is pried in the direction D3 of thickness thereof, the plug-side connector 21 is brought into contact with the guide surfaces 53*b*. At this time, the guide surfaces 53*b* are substantially perpendicularly abutted against the plug-side connector 21. Since the guide surfaces 53*b* are not moved unless the connecting section 53 is elastically deformed, the prying motion of the plug-side connector 21 is suppressed. This prevents the guide section 32 of the housing 3 from being pried by the plug-side connector 21.

According to the present embodiment, even if the plug-side connector 21 is inserted into the receiving hole 31 of the receptacle-side connector 1 in a prying manner, the guide section 32 of the receptacle-side connector 1 is hardly damaged or broken by the plug-side connector 21.

It is further understood by those skilled in the art that the foregoing is the preferred embodiment of the present invention, and that various changes and modification may be made thereto without departing from the spirit and scope thereof.

What is claimed is:

1. A connector comprising:

a housing that holds a plurality of contacts, and includes a receiving hole for receiving a mating connector, and two guide sections located at respective opposite ends of the receiving hole in a contact arrangement direction, for guiding the mating connector in a fitting direction; and a shell that is formed by a metal plate, and includes a first covering section that covers a first outer surface of said housing, said first outer surface being substantially parallel to the contact arrangement direction, a second covering section that covers a second outer surface of said housing, said second outer surface being substantially parallel to the contact arrangement direction, and two connecting sections that connect said first covering section and said second covering section and cover opposite ends of a front of said housing, wherein said two connecting sections have respective cutouts opposed to said guide sections in the fitting direction, and wherein each cutout has a pair of guide surfaces opposed to each other in a direction of thickness of said housing, for guiding the mating connector in the fitting direction.

* * * * *